US005607337A

United States Patent [19]

Callahan

[11] Patent Number: 5,607,337

[45] Date of Patent: Mar. 4, 1997

[54] INFANT MEMORABILIA SYSTEM

[76] Inventor: Glenda C. Callahan, 413 Jean St., Houma, La. 70360

[21] Appl. No.: 402,096

[22] Filed: Mar. 10, 1995

[51] Int. Cl.[6] ..... A63H 3/02

[52] U.S. Cl. ..... 446/369; 446/268; 446/390; 434/155

[58] Field of Search ..... 446/72, 369, 385, 446/390, 391, 321, 372; 434/84, 86, 100, 155, 267

[56] References Cited

U.S. PATENT DOCUMENTS

| | | | |
|---|---|---|---|
| 2,656,647 | 10/1953 | Schepp | 446/385 |
| 3,783,553 | 1/1974 | Goozner | 446/391 |
| 3,863,386 | 2/1975 | Kinberg | 446/391 |
| 4,020,586 | 5/1977 | Benner | 446/321 |
| 4,795,397 | 1/1989 | Stevens | 446/320 |
| 4,993,987 | 2/1991 | Hull et al. | 446/268 |
| 5,046,985 | 9/1991 | Cearfoss | 446/372 |
| 5,059,149 | 10/1991 | Stone | 446/369 |
| 5,143,551 | 10/1992 | Mason, Jr. et al. | 118/31.5 |
| 5,257,955 | 11/1993 | Jones | 446/394 |
| 5,330,231 | 7/1994 | Godfrey | 40/124.1 |
| 5,403,224 | 4/1995 | Gintling | 446/321 |

FOREIGN PATENT DOCUMENTS

| | | | |
|---|---|---|---|
| 2182857 | 5/1987 | United Kingdom | 446/385 |
| 2239814 | 7/1991 | United Kingdom | 446/385 |

*Primary Examiner*—Robert A. Hafer
*Assistant Examiner*—Jeffrey D. Carlson
*Attorney, Agent, or Firm*—Joseph N. Breaux

[57] ABSTRACT

A system for memorializing the birth of an infant comprising a marking medium and a soft sculpture. The marking medium is appliable to the palms and soles of the infant's hands and feet and is used to replicate the epidermal pattern of the infant's hands and feet upon a substrate. The soft sculpture includes an area of substrate on an outer surface thereof which is suitable for receiving thereon markings replicating the epidermal pattern of the infants hands and feet. The soft sculpture may include a protective cover for covering the area of substrate upon which the pattern is placed. The protective cover is preferably clear, and more preferably, includes a sheet of flexible plastic attached along an edge thereof to the soft sculpture. The sheet of flexible plastic may include an adhesive material on a portion thereof to allow the protective cover to be secured over the substrate area after the feet and hand prints are placed thereon.

3 Claims, 4 Drawing Sheets

INFANT MEMORABILIA SYSTEM

TECHNICAL FIELD

The present invention relates to devices and methods for memorializing the birth of a new baby and more particularly to devices and methods for memorializing the birth of a new baby that include at least one hand and foot print impression site.

BACKGROUND ART

The birth of a new baby into a family is generally an occasion for friends and family to visit the new arrival either at the hospital or at home. It would be desirable to have a record of those people who visited the infant, as well as, a device for preserving the hand and foot prints of the child as an aid in remembering the happy occasion in future years.

GENERAL SUMMARY DISCUSSION OF INVENTION

It is thus an object of the invention to provide a infant memorabilia system that allows individuals visiting the child to memorialize their visit.

It is a further object of the invention to provide a infant memorabilia system that is safe for use on infants.

It is a still further object of the invention to provide a infant memorabilia system that provides a mechanism for preserving the hand and foot prints of an infant.

It is a still further object of the invention to provide a infant memorabilia system that is simple to use.

Accordingly, a system for memorializing the birth of an infant is provided. The system comprises: a marking medium and a soft sculpture.

The marking medium is appliable to the palms and soles of the infant's hands and feet. The marking medium is used to replicate the epidermal pattern of the infant's hands and feet upon a substrate by applying the marking medium to the palms and soles of the infant and then pressing the palms and soles onto the substrate.

The soft sculpture includes an area of substrate on an outer surface thereof which is suitable for receiving thereon markings replicating the epidermal pattern of the infants hands and feet. The soft sculpture may include a protective cover for covering the area of substrate upon which the pattern is placed.

The protective cover is preferably clear to allow protected viewing of the hand and foot prints, and, more preferably, includes a sheet of flexible plastic attached along an edge thereof to the soft sculpture. In a preferred embodiment, the sheet of flexible plastic includes an adhesive material on a portion thereof to allow the protective cover to be secured over the substrate area after the feet and hand prints are placed thereon.

In another preferred embodiment, the marking medium may be supplied in combination with an absorbent member which is soaked with a quantity of marking medium in a liquid form in order to assist application of the marking medium to the palms and soles of the infant's hands and feet. The absorbent member is preferably in the form of a towelette or pad. In addition, the system may include a supply of a cleaning agent, such as alcohol, to remove the excess marking medium from the palms and soles of the infant after the palm and sole prints are placed on the substrate.

In another preferred embodiment of the infant memorabilia system, the soft sculpture includes an exterior surface portion constructed of a material upon which writing may be placed; and the system further includes a writing instrument, attached to the soft sculpture, to allow visitors to conveniently write upon the exterior surface portion of the soft sculpture while they are visiting.

In another preferred embodiment, the soft sculpture includes at least two separate substrate areas on an outer surface thereof for receiving thereon markings replicating an epidermal pattern of at least one of the infants hands and feet.

In another preferred embodiment, the soft sculpture includes at least four separate substrate areas on an outer surface thereof for receiving thereon markings replicating an epidermal pattern of one of the infants hands and feet.

In another preferred embodiment, the soft sculpture includes a body section having at least four appendages extending therefrom, each of the appendages including one of the separate substrate areas. When this embodiment is used, the soft sculpture is preferably of an animal having at least four appendages and wherein each of the separate substrate areas is located in a position corresponding to the contacting area of the appendage. The term "contacting area" is used herein to mean an area of the animal appendage which is used to contact a structure for locomotion in a manner analogous to the palms and soles of human hands and feet.

In another aspect of the invention, an infant memorabilia system is provided comprising a soft sculpture having an area of substrate on an outer surface thereof which is suitable for receiving thereon markings replicating the epidermal pattern of the infants hands and feet and an exterior surface portion constructed of a material upon which writing may be placed; and a writing instrument, attached to the soft sculpture, for allowing visitors to write upon the exterior surface portion of the soft sculpture.

In another aspect of the invention a method of memorializing the birth of an infant is provided. The method comprises the steps of: a) providing a quantity of marking medium, appliable to a palm section of the infant's hands and a sole section of the infant's feet, for replicating the epidermal pattern of the infant's hands and feet upon a substrate; b) providing a soft sculpture having an area of substrate on an outer surface thereof suitable for receiving thereon markings replicating the epidermal pattern of the infants hands and feet; c) applying the marking medium to the palm sections and the sole sections of the infant; and d) pressing the palm sections and the sole sections having the marking medium applied thereon against the area of substrate in a manner such that the epidermal patterns of the infant's palms and soles is created on the area of substrate.

In a preferred method, the soft sculpture provided further includes a protective cover for covering the area of substrate; and the method further includes the step of covering the area of substrate having the epidermal patterns of the infant's palms and soles created thereon with the protective cover.

In another preferred method, the soft sculpture provided includes an exterior surface portion constructed of a material upon which writing may be placed; and a writing instrument, attached to the soft sculpture, for allowing visitors to write upon the exterior surface portion of the soft sculpture; and the method further includes the step of utilizing the writing instrument to create indicia of visiting the infant upon the exterior surface portion.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

An exemplary embodiment of the infant memorabilia system of the present invention is now described with reference to FIGS. 1–7. The exemplary embodiment of the infant memorabilia system includes a soft sculpture having four appendages and a pen-type marker attached thereto; a marking medium pad that is soaked with a quantity of marking medium and enclosed within a fluid tight container; and a cleaning towelette that is soaked with a quantity of cleaning agent and enclosed within a fluid tight container.

Figure 1:
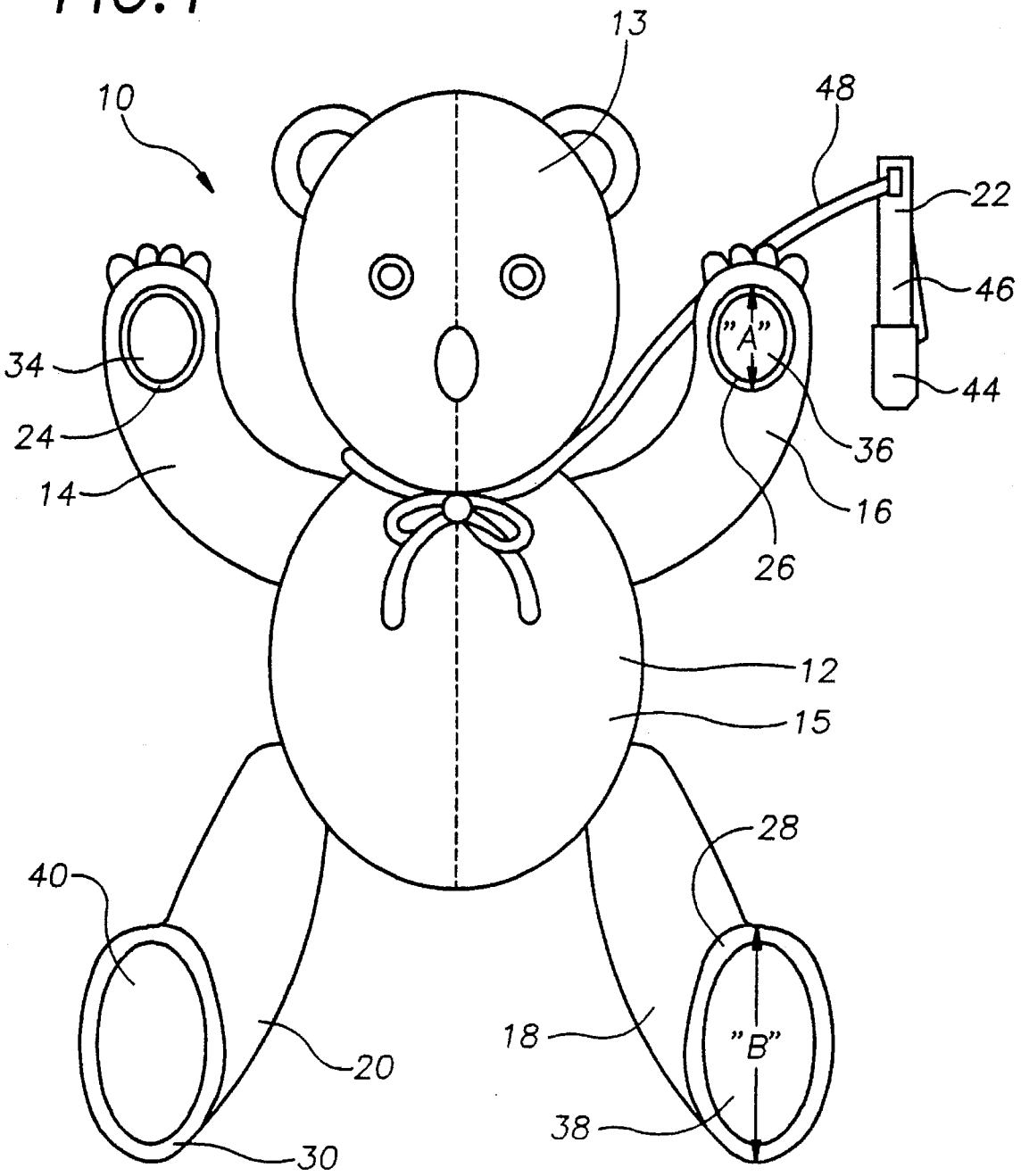
FIG. 1 is a frontal view of an exemplary embodiment of the soft sculpture of the system of the invention.

FIG. 1 shows an exemplary embodiment of a soft sculpture of the invention, generally designated by the numeral 10. In this embodiment, soft sculpture 10 is a stylized bear sculpture including a body portion 12, four appendages 14,16,18,20, and a marker 22. Body portion 12 includes an interconnected head portion 13 and torso portion 15. The exterior surface of the head 13 and torso 15 portions are constructed from canvas fabric.

Each of the four appendages 14,16,18,20 is constructed from canvas fabric and secured to torso portion 15. The other end of each appendage 14,16,18,20 includes an elliptically shaped substrate section, 24,26,28,30 respectively, positioned near the other end thereof. Substrate sections 24,26 measure a length sufficient in the direction "A" to allow the palm prints of an infant to be placed thereon. Substrate sections 28,30 measure a length sufficient in the direction "B" to allow the foot prints of an infant to be placed thereon.

In this embodiment, substrate sections 24,26,28, and 30 are constructed from cardboard having an smooth, ink receiving, finish on the exteriorly oriented side. In addition, each substrate section 24,26,28 and 30 includes an elliptically shaped, clear, flexible plastic, protective cover 34,36, 38,40.

Figure 2:
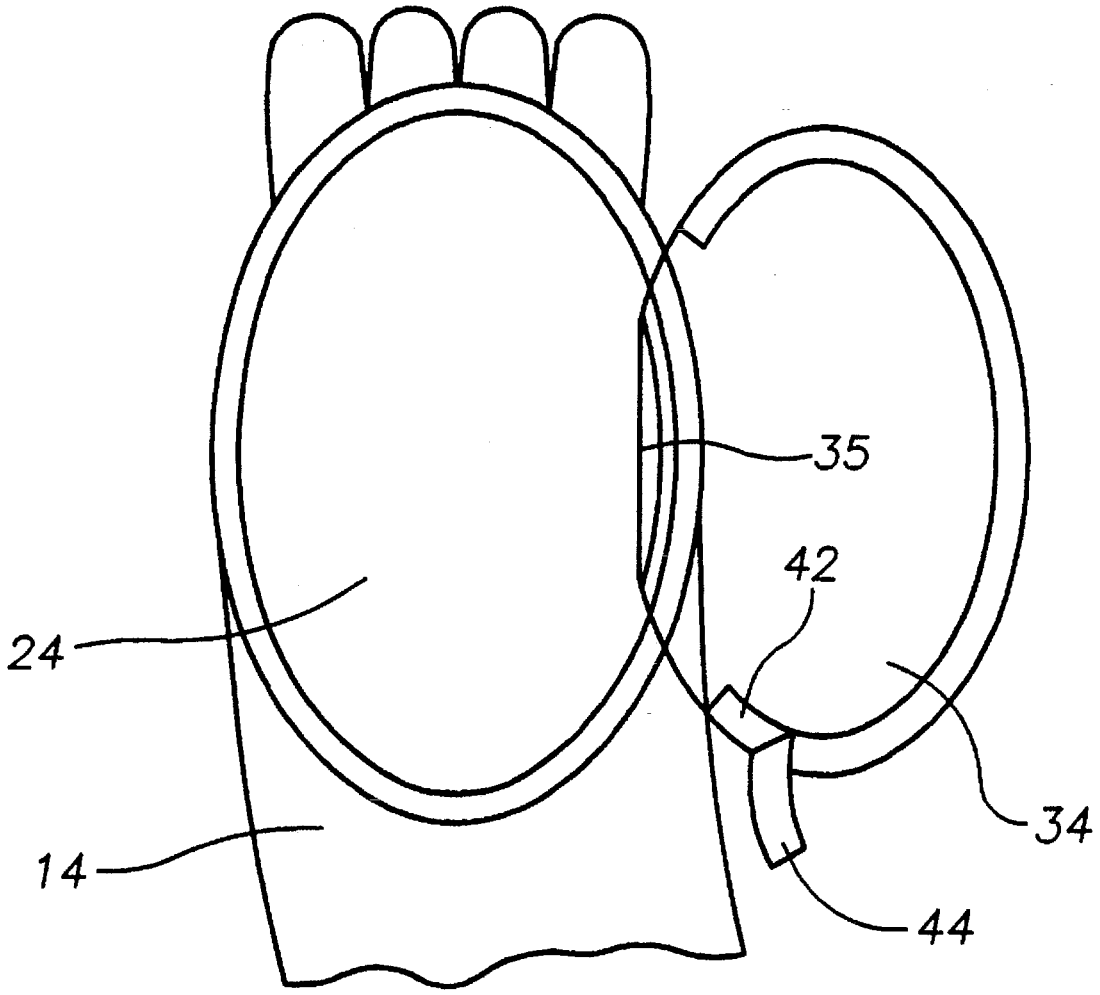
FIG. 2 is a detail view of the end of one appendage having a section of substrate and an embodiment of the protective cover attached thereto.

Although the following discussion is made with particular reference to appendage 14, the discussion is applicable to all four appendages 14,16,18,20. FIG. 2 is a detail view of the end of appendage 14 having substrate section 24 thereon.

One edge 35 of protective cover 34 is affixed to substrate section 24. Protective cover 34 includes an adhesive section 42 along a portion of the perimeter not containing edge 35. Adhesive section 42 is covered by a removable non-stick tape 44 which is removed when it is desired to affix protective cover 34 over substrate section 24 once the palm or sole print has been placed thereon.

With reference once again to FIG. 1, marker 22 is a conventional felt tip type marker and includes a cap 44 and a writing instrument 46. Writing instrument 46 is attached to body portion 12 with about a twelve inch length of ribbon 48.

Figure 3:
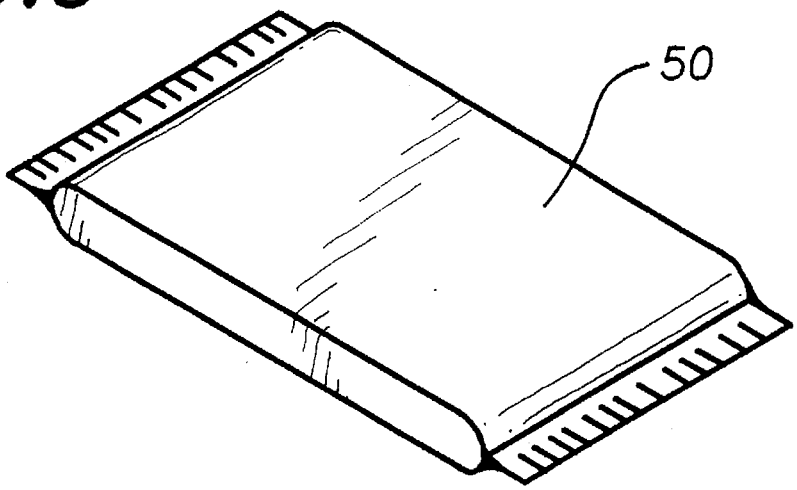
FIG. 3 is a perspective view of an embodiment of the marking medium container with the pad member enclosed therein.

FIG. 3 is a perspective view showing an embodiment of a marking medium container 50 with a pad member enclosed therein. Marking medium container 50 is a plastic film tube which has been sealed at both ends.

Figure 4:
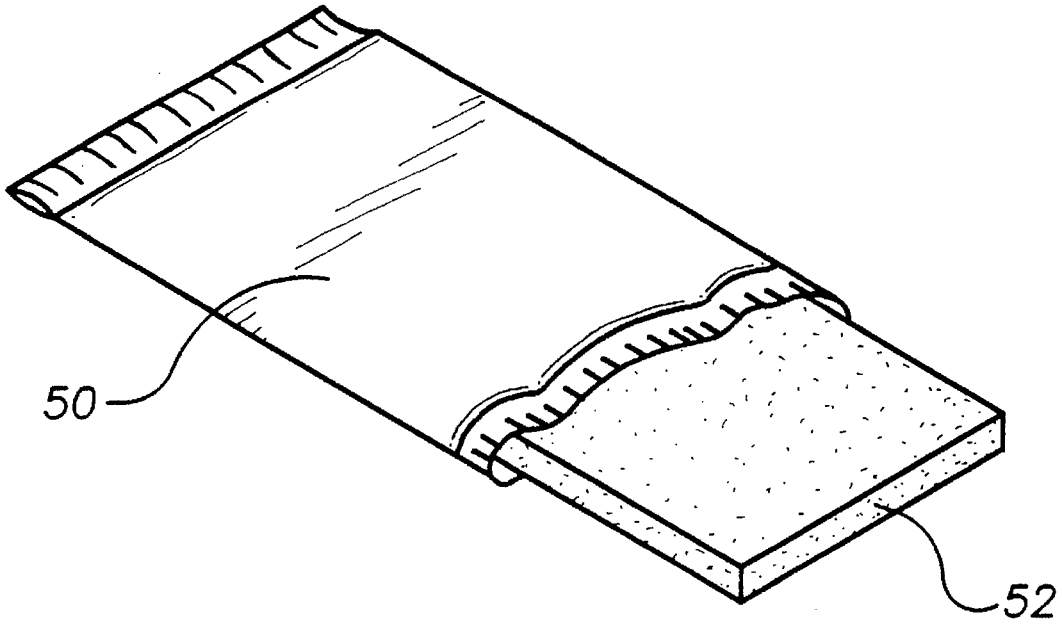
FIG. 4 is a perspective view showing the pad member extending partially out of the marking medium container.

FIG. 4 shows a pad member 52 extending partially out of an open marking medium container 50. In this exemplary embodiment, pad member 52 is a substantially rectangular shaped, foam pad that has been soaked with a small quantity of non-toxic ink.

Figure 5:
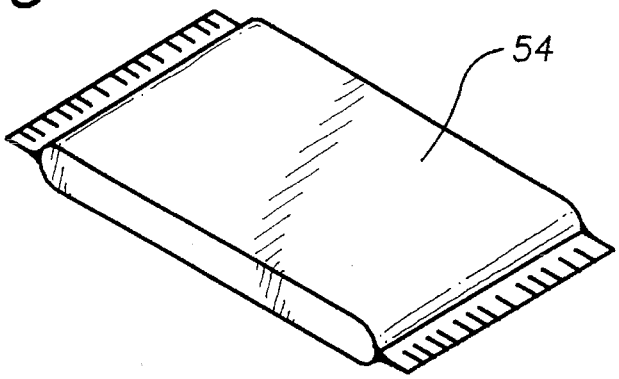
FIG. 5 is a perspective view showing an embodiment of the cleaning agent container with the cleaning towelette enclosed therein.

FIG. 5 is a perspective view showing an embodiment of a cleaning agent container 54 with a cleaning towelette enclosed therein. Cleaning agent container 54 is a plastic film tube which has been sealed at both ends.

Figure 6:
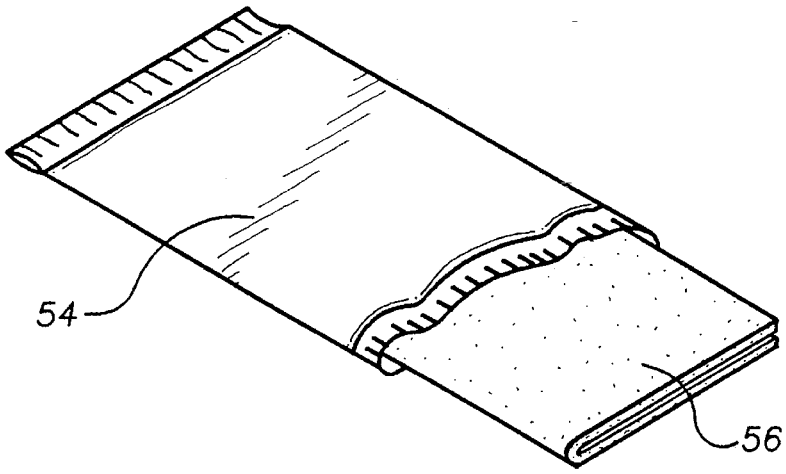
FIG. 6 is a perspective view showing an embodiment of the cleaning agent container with the folded cleaning towelette extending partially out therefrom.
Figure 7:
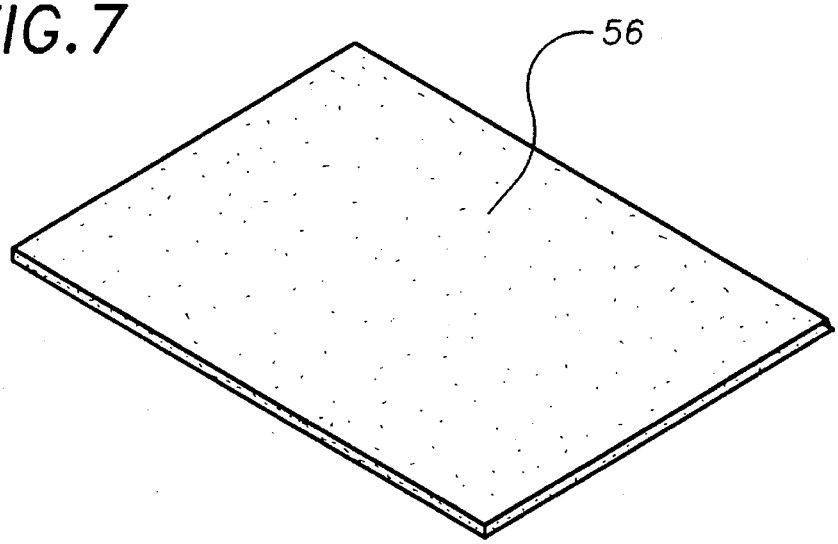
FIG. 7 is a perspective view showing the cleaning towelette in the fully unfolded configuration.

FIG. 6 shows an embodiment of the cleaning agent container 54 with a folded cleaning towelette extending partially therefrom. In this exemplary embodiment, cleaning towelette is soaked in a quantity of alcohol. FIG. 7 shows cleaning towelette 56 in the fully unfolded configuration.

Use of the infant memorabilia system is now described with reference to FIGS. 1–7. The pad member 52 is at least partially removed from marking medium container 50 and placed in contact with the soles and palms of the infant. This contact places a quantity of the ink onto the palm and sole surfaces. The palm and sole prints are then created on substrate sections 24,26,28, and 30. After theses prints are created, cleaning towelette 56 is removed from cleaning agent container 54 and used to remove the remaining ink from the soles and palms of the infant.

After the sole and palm prints have dried, the four sections of non-stick tape 44 are removed from adhesive sections 42 and protective covers 34,36,38, and 40 are secured over substrate sections 24,26,28, and 30, respectively.

In addition to having the sole and palm prints of the infant, each visitor may sign and/or write a message to the infant upon the exterior of soft sculpture 10 using marker 22.

An exemplary embodiment of the method is now described with reference to FIGS. 1–7. The method comprises the steps of: a) providing a pad member 52 soaked in a quantity of ink and enclosed within a marking medium container 50; b) providing a soft sculpture 10 including a body portion 12, four appendages 14,16,18,20, and a marker 22, each appendage 14,16,18,20 including an elliptically shaped substrate section, 24,26,28,30 respectively, positioned near one end thereof, each substrate section 24,26, 28,30 including an elliptically shaped, clear, flexible plastic, protective cover 34,36,38,40; c) applying the ink to the palm sections and sole sections of the infant; d) pressing, in turn, the palm sections and sole sections having the ink applied thereon against a section of substrate in a manner such that the epidermal pattern of one of the infant's palms and soles is created on one substrate section 24,26,28,30; and e) placing each protective cover 34,36,38,40 over its respective substrate section 24,26,28,30.

It can be seen from the preceding description that a method and device for memorializing the birth of a new baby which allows individuals visiting the child to memorialize their visit, which is safe for use on infants, which preserves the foot and hand prints of an infant, and which is simple to use has been provided.

It is noted that the embodiment of the infant memorabilia system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A system for memorializing the birth of an infant comprising:

marking medium means suitable for application to an infant's hands and feet, said marking medium being a quantity of non-toxic ink soaked into an absorbent pad;

a marking medium container enclosing said absorbent pad, said marking medium container being a plastic film tube which has been sealed at both ends;

a cleaning agent container containing a cleaning towelette enclosed therein; and a soft sculpture having four separate elliptically shaped areas of substrate on an outer surface thereof suitable for receiving thereon markings created by said marking medium means and each having a clear, elliptically shaped, flexible plastic cover for covering said area of substrate, said protective means including a clear cover including a sheet of flexible plastic, a first edge portion of said protective cover being affixed to said area of substrate, a second edge portion of said protective cover not containing said first edge portion having an adhesive deposited thereon that is covered by a removable non-stick tape member.

2. The infant memorabilia system of claim 1, wherein:

said soft sculpture includes an exterior surface portion constructed of a material upon which writing may be placed; and said system further includes:

writing instrument means, attached to said soft sculpture, for allowing visitors to write upon said exterior surface portion of said soft sculpture.

3. The infant memorabilia system of claim 1 wherein:

said soft sculpture includes a body section having at least four appendages extending therefrom, each of said appendages including one of said four separate areas.

* * * * *